United States Patent [19]

Powell

[11] 4,456,058

[45] Jun. 26, 1984

[54] HEAT EXCHANGER TUBE SUPPORT

[75] Inventor: John R. Powell, Tulsa, Okla.

[73] Assignee: Brown Fintube Company, Houston, Tex.

[21] Appl. No.: 445,667

[22] Filed: Nov. 30, 1982

[51] Int. Cl.[3] ..... F28D 7/10; F28F 9/00

[52] U.S. Cl. ..... 165/154; 138/112; 138/113; 138/114; 138/148; 165/162

[58] Field of Search ..... 165/162, 154; 138/112, 138/113, 114, 148

[56] References Cited

U.S. PATENT DOCUMENTS

| | | | |
|---|---|---|---|
| 2,325,616 | 8/1943 | Landweber | 138/113 X |
| 2,510,825 | 6/1950 | Lechtenberg | 138/114 X |
| 2,962,053 | 11/1960 | Epstein | 138/113 |
| 3,144,081 | 8/1964 | Skiba | 165/162 |

FOREIGN PATENT DOCUMENTS

| | | | |
|---|---|---|---|
| 603278 | 12/1932 | Fed. Rep. of Germany | 138/148 |
| 28885 | of 1897 | United Kingdom | 138/148 |

*Primary Examiner*—Sheldon J. Richter

*Attorney, Agent, or Firm*—Burns, Doane, Swecker & Mathis

[57] ABSTRACT

The present invention relates to a heat exchanger tube support for supporting a plurality of heat exchanger tubes in a conduit of a heat exchanger. The heat exchanger tube support includes three identical elements each having a flattened W-shaped configuration defined by a central projection and two diverging leg sections. A channel is defined in the area between each leg section and the projection. The elements are secured together with a leg section of each element being welded to a leg section of each adjacent element and with the projections extending radially outward. The elements enclose an interior area through which a central heat exchanger tube passes. Six outer heat exchage tubes are supported in a radial array on the heat exchanger tube support within each channel. The leg sections of each element extend to the inside wall of the conduit to space the heat exchanger tubes from the inside wall.

14 Claims, 4 Drawing Figures

HEAT EXCHANGER TUBE SUPPORT

BACKGROUND AND SUMMARY OF THE PRESENT INVENTION

The present invention relates to heat exchangers and more specifically relates to a heat exchanger tube support for supporting a plurality of heat exchanger tubes within a heat exchanger.

As known in the art, a heat exchanger transfers heat from a relatively high temperature fluid to a relatively low temperature fluid. Typically, the heat exchanger includes a cylindrical conduit of considerable length having a plurality of tubular heat exchanger tubes supported therein. For the most part, the tubes are straight and extend parallel to a longitudinal axis of the conduit for the length of the conduit. However, the heat exchanger may include a plurality of conduits sequentially interconnected at their ends by hairpin conduit portions with a bundle of tubes within one conduit connected to a successive bundle in an adjacent conduit by a hairpin tube portion.

A conventional heat exchanger operates with a first fluid circulating through a path within the conduit defined by the heat exchanger tubes. A second fluid flows in a longitudinal direction through the conduit and in contact with the tubes. Heat is transferred from the hotter fluid through the tubes to the cooler fluid as the hotter fluid contacts surfaces of the heat exchanger tubes.

The heat exchanger tubes are normally arranged within the heat exchanger conduit in a spaced, parallel relationship relative to one another. However, due to the length of the heat exchanger conduit, the tubes arranged therein tend to sag or bend. In order to maintain the spaced, parallel relationship among the tubes, the tubes are braced at intervals along the longitudinal axis of the conduit.

In known heat exchangers, the tubes are supported at each interval by a circular plate having a diameter substantially equal to the inside diameter of the conduit and extending in a plane perpendicular to the longitudinal direction of flow of the second fluid. The plate has apertures through which both the tubes and the second fluid pass. This type of tube support, however, reduces the efficiency (i.e., the percentage of heat transferred) of the heat exchanger by restricting the flow of the second fluid through the conduit. In order to reduce the flow restrictions associated with these plates, peripheral portions of the plates are cut away to partially eliminate obstructions to the flow of the second fluid. This solution, however, creates a serpentine flow of the second fluid about an outer periphery of the bundle of heat exchanger tubes wherein radially inward portions of the tubes are not freely contacted by the flow of the second fluid. Instead, pools of relatively stationary fluid tend to form at various places in the heat exchanger. The serpentine flow thus inhibits the free flow of the second fluid through the conduit and decreases the efficiency of the heat exchanger.

In order to increase the efficiency of the heat exchanger, a support for the tubes should maximize areas of contact between the flow of the second fluid and the tubes, while minimizing the flow restrictions encountered by the second fluid. Therefore, the support for the tubes should maintain the tubes in a spaced, parallel relationship within the conduit to maximize the contact between the second fluid and the tubes. Further, a support for the tubes should separate the tubes from the inside walls of the conduit and from adjacent tubes, thereby enabling the second fluid to contact substantially all of the exterior surface of each tube. The support should also provide a rigid support which resists any movement of the tubes within the support and which resists any movement of the bundle of tubes within the conduit. However, all of these objectives should be accomplished without unduly restricting the flow of the second fluid through the conduit. Consequently, in positioning the tubes within the conduit, the supports should have a configuration which presents a minimal surface area in a plane perpendicular to the direction of flow, so as not to unnecessarily obstruct the flow of the second fluid through the conduit.

A known heat exchanger tube support is disclosed in U.S. Pat. No. 3,144,081 issued to Skiba and assigned to the assignee of the present invention. Briefly, that support includes a central tubular member which radially supports a first set of three identical V-shaped channel members each having two outwardly diverging sidewalls. A second set of three smaller identical V-shaped channel members with smaller outwardly diverging sidewalls is also secured about the central member. Each smaller channel member is alternately disposed relative to each channel member of the first set. A central tube is received within the central member and six outer tubes are radially supported in a spaced, parallel relationship about the heat exchanger tube support. Each outer tube occupies a separate area defined by the diverging sidewalls of each V-shaped channel member. A band wrapped around the bundle of tubes secures the tubes to the support. The diverging sidewalls of the first set of channel members extend from the central member to the inside wall of the conduit to space the heat exchanger tubes from the inside wall of the conduit.

In the heat exchanger tube support of the Skiba patent, however, the heat exchanger tube support includes seven distinct elements (i.e., one central tubular member, three V-shaped channel members of the first set, and three V-shaped channel members of the second set) in order to support the six outer tubes and one central tube of the heat exchanger. Each of these seven elements must be secured together at six connection points. Further, of the seven elements, there are three separate configurations necessitating three manufacturing processes to produce each configuration.

Other supports for heat exchager tubes are known. For example, heat exchanger tube supports are disclosed in U.S. Pat. No. 3,134,432 issued to Means; U.S. Pat. No. 3,239,426 issued to Waine et al; U.S. Pat. No. 3,858,646 issued to Naylor; U.S. Pat. No. 4,265,301 issued to Anderson; and U.S. Pat. No. 4,320,566 issed to Boyer et al.

A general object of the present invention is to provide a heat exchanger tube support which overcomes the disadvantages associated with known heat exchanger tube supports.

Another object of the present invention is to provide a heat exchanger tube support which is less expensive to manufacture and less difficult to assemble than known heat exchanger tube supports.

Still another object of the present invention is to provide a significantly simplified heat exchanger tube support which is formed from sets of identical elements.

A further object of the present invention is to provide a heat exchanger tube support which maintains the heat exchanger tubes in a spaced, parallel relationship within a conduit of a heat exchanger.

It is a further object of the present invention to provide a heat exchanger tube support which provides a rigid support for the tubes within the support and the bundle of tubes within the conduit.

A still further object of the present invention is to provide a heat exchanger tube support which does not unduly restrict the flow of fluid within the heat exchanger.

These and other objects and advantages will become apparent to those skilled in the art upon reading the following detailed description of the preferred embodiment of the present invention.

A heat exchanger tube support according to the present invention supports a plurality of heat exchanger tubes in a conduit of a heat exchanger. The heat exchanger tube support includes three elements each being a strip of material defining a projection at a mid-section thereof. Two leg sections extend from the projection and a channel is defined between each leg section and the projection. An attachment mechanism secures the elements together with each leg section of each element being secured to a leg section of an adjacent element, with each leg section extending radially outward and with the channels on each element opening radially outward. In an assembled condition, the elements together enclose an interior area within the heat exchanger tube support.

In a preferred embodiment, each channel is adapted to receive at least one heat exchanger tube and the projections and leg sections are adapted to separate individual heat exchanger tubes within adjacent channels. The leg section of each element extends to the inside wall of the conduit to space the heat exchanger tubes from the inside wall of the conduit.

BRIEF DESCRIPTION OF THE DRAWINGS

A preferred embodiment of the heat exchanger tube support according to the present invention is described with reference to the accompanying drawings in which.

DETAILED DESCRIPTION OF THE PREFERRED EMBODIMENT

Figure 1:
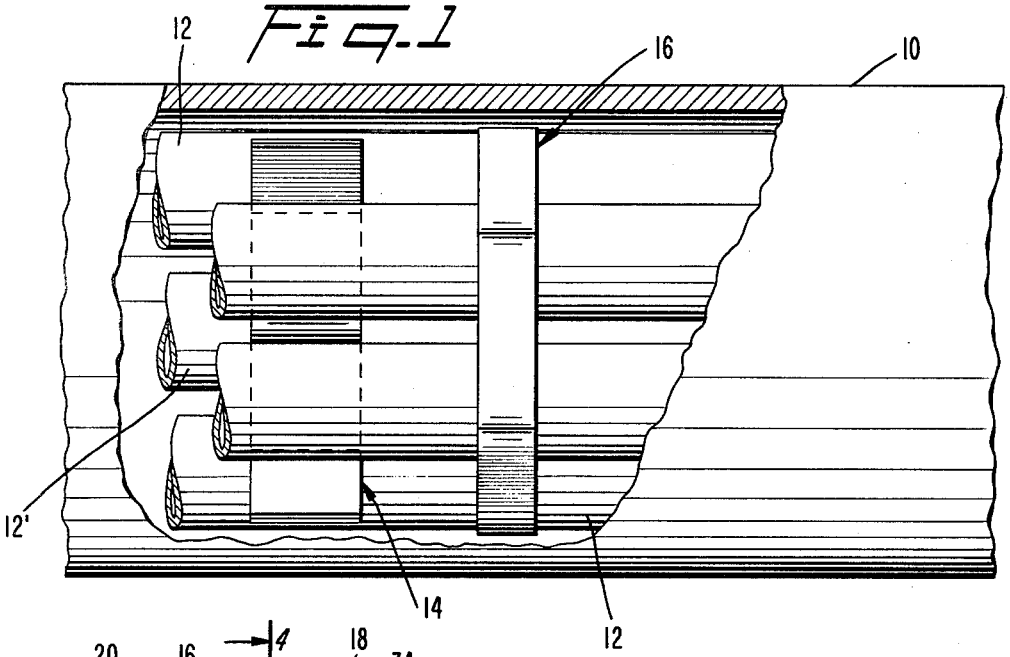
FIG. 1 is a side view of a section of a conduit for a heat exchanger with portions of the conduit being broken away showing the heat exchanger tube support according to the present invention.

With reference to FIG. 1, a section of a heat exchanger having a support according to the present invention includes a cylindrical conduit 10 having a plurality or bundle of tubes 12 supported therein. The tubes 12 are straight and extend parallel to a longitudinal axis of the conduit 10 for the length of the conduit. The tubes are supported in a spaced, parallel relationship at particular intervals along the length of the conduit 10 by heat exchanger tube supports 14, one of which is shown in FIG. 1. A band 16 surrounds the bundle of tubes adjacent to the tube support 14 and secures the tubes to the support. The support 14 may be used in any suitable, conventional heat exchanger, such as that disclosed in U.S. Pat. No. 3,144,081, herein incorporated by reference.

Figure 2:
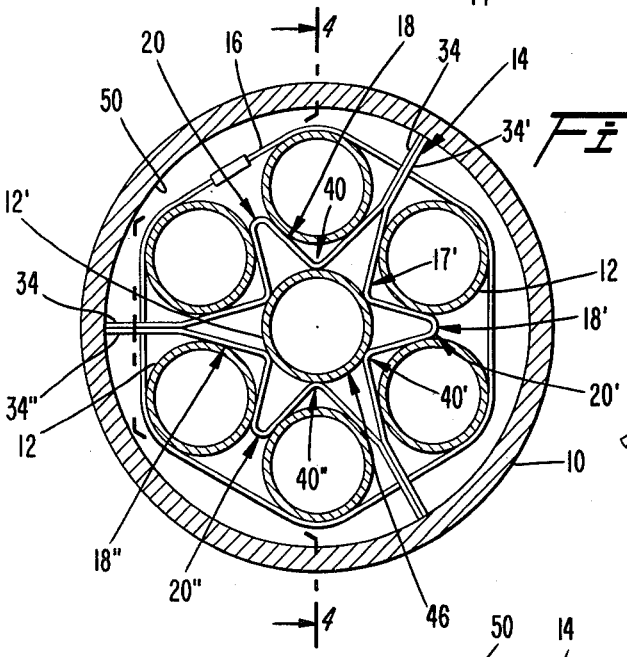
FIG. 2 is a cross-sectional view of the heat exchanger tube support of FIG. 1 having heat exchanger tubes supported therein.
Figure 3:
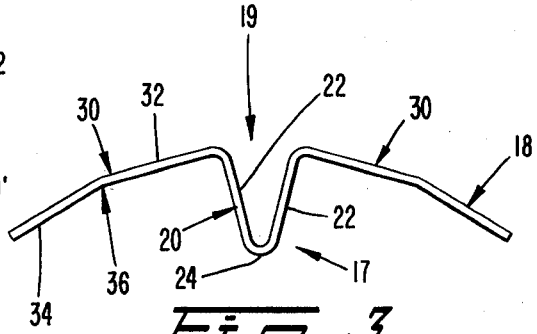
FIG. 3 is an end view of a heat exchanger tube support member according to the present invention.

With reference to FIG. 2, the heat exchanger tube support 14 includes three elements 18, 18′, 18″ which preferably have identical configurations. Each element includes a strip of material, such as metal preferably manufactured from carbon steel, stainless steel, chrome alloy, copper or other suitable metals. As illustrated in FIG. 3, a strip 18 is formed to have a generally concave side 17 and a generally convex side 19.

Referring now to FIGS. 2 and 3, a projection or V-shaped notch 20 is formed in a mid-section of each element 18 with the projection 20 extending into an area partially encompassed by the concave side 17 of the element 18. The projection 20 includes two arms 22 diverging from an apex 24 of the projection 20 with an acute angle being defined by the two diverging arms 22. The apex 24 of the projection 20 is approximately located at a mid point of the element 18, so that each element 18 is symetrical about the projection 20.

A leg section 30 extends from a base of each diverging arm 22. Each leg section 30 includes an intermediate portion 32 and an end portion 34. The intermediate portion 32 of the leg section 30 extends from the base of the diverging arm 22 to a bend point 36. The end portion 34 of the leg section 30 extends from the bend point 36 and preferably projects at an angle from a longitudinal axis of the intermediate portion 32.

When viewed from either end, the projection 20 in the element 18 (including the diverging arms 22), and the leg sections 30 (including the intermediate and end portions 32, 34), together define a structure being a flattened W-shape configuration (shown inverted in FIG. 3). The W-shaped configuration of the element may be formed by stamping each strip between two cooperating dies to form the element. However, it is preferable to form the element by rolling a sheet of material to the desired configuration and then cutting the individual strips from the sheet.

With reference now to FIG. 2, the heat exchanger tube support 14 is assembled by securing three identical elements 18, 18′, and 18″ together. One end portion 34 of the element 18 is secured by spot welds to one end portion 34′ of the adjacent element 18′ with the projections 20, 20′ on each element 18, 18′ extending radially outwardly toward the area partially encompassed by the concave side 17, of each element 18, 18′. The end portions 34″ of the third element 18″ are then secured in the above-described manner by spot welds to the other end portions 34, 34′ of the elements 18, 18′.

A channel 40 is defined between each diverging arm 22 of the projection 20 and each intermediate portion 32 of the leg sections 30. In this way, six distinct channels are provided symmetrically about the tube support 14. With this construction, the channels 40, 40′, 40″ of each element 18, 18′, 18″ open radially outward.

In an assembled condition, the heat exchanger tube support 14 has a six pointed star-shaped configuration with a first set of three points being defined by the projections 20, 20′, 20″ on each element 18, 18′, 18″. A second set of three remaining points is defined by the leg sections 30, 30′, 30″ of each element 18, 18′, 18″. It is noted that each point of the second set is elongated due to the end portions 34, 34′, 34″ of each leg section 30, 30′, 30″ of each element 18, 18′, 18″. The second set of points is alternatively disposed between the first set of points with the channels 40, 40′, 40″ located between each point.

The heat exchanger tube support 14 defines an interior area 46 which is enclosed by the convex surfaces of the three elements 18, 18', 18''. In order to more securely support the heat exchanger tubes 12, the heat exchanger tube support 14 preferably has a central tube 12' passing through the interior area 46 of the support. The central tube 12' contacts the heat exchanger tube support 14 on the convex surfaces of the elements 18, 18', 18'' adjacent to the bases of each diverging arm 22.

Six outer heat exchanger tubes 12 are supported in a radial array on the heat exchanger tube support 14 with each element 18, 18', 18'' supporting two heat exchanger tubes 12. Each tube 12 is supported on a particular element 18 within the channel 40 defined between the diverging arm 22 of the projection 20 and the intermediate portion 32 of the leg section 30. The tubes 12 supported on a particular element 18 are separated from each other by the first set of points defined by the projections 20 formed in the element. The tubes supported on adjacent elements 18, 18', 18'' are separated from each other by the second set of points defined by the leg sections 30, 30', 30'' of adjacent elements 18, 18', 18''. The band 16 surrounds the bundle and is arranged about the heat exchanger tube support to secure the tubes to the support.

Figure 4:
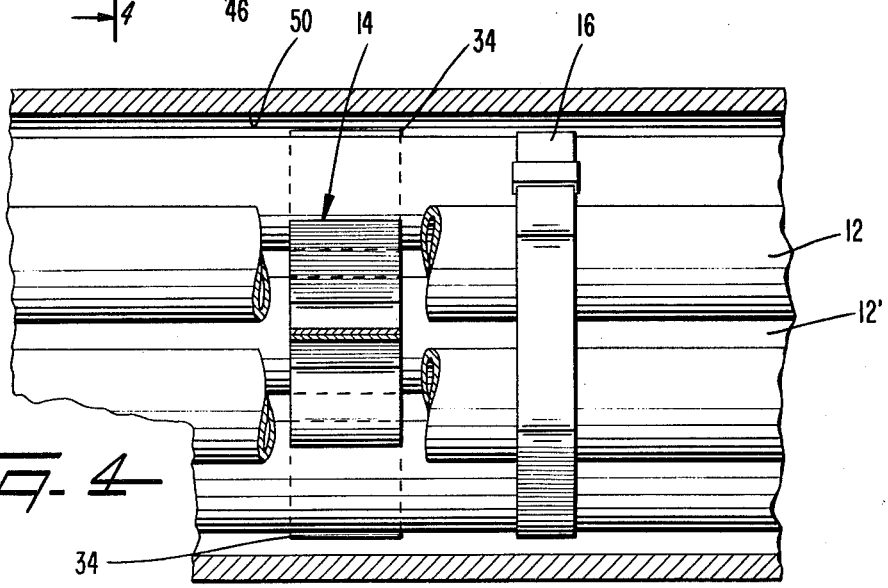
FIG. 4 is a view through the line 4—4 of FIG. 2.

With reference now to FIGS. 2 and 4, the end portion 34, 34', 34'' of each leg section 30, 30', 30'' contacts the inside wall 50 of the conduit 10 to space the bundle of tubes 12 from the inside wall 50. It is preferred that each leg section 30, 30', 30'' has a length sufficient so as to space the tubes 12 from the inside wall 50.

With this construction, the heat exchanger tube support of the present invention provides a support which maintains the heat exchanger tubes in a spaced, parallel relationship within the conduit. The heat exchanger tube support according to the present invention also separates the heat exchanger tubes from the inside wall of the conduit and from adjacent tubes. Thus, substantially all of the exterior surface of the heat exchanger tubes are readily contacted by the second fluid flowing through the conduit.

Further, the heat exchanger tube support of the present invention does not unduly restrict the flow of the second fluid through the second conduit. The heat exchanger tube support according to the present invention presents a minimal amount of surface area in a plane perpendicular to the direction of the flow. In addition, the heat exchanger tube support provides for flow through the interior of the support, between adjacent outer tubes and between the tubes and the inside walls of the conduit.

While providing all of the above-described advantageous characteristics, the present invention also provides a heat exchanger tube support which is less difficult to assemble and less expensive to manufacture than known heat exchanger tube supports. The heat exchanger tube support of the present invention includes three elements which are secured together at only three connection points. The minimal number of elements and reduced number of connection points facilitates the assembly of the heat exchanger tube support. Preferably, the elements have identical configurations, so that only a single manufacturing process is required to produce the configuration. Further, the elements are relatively inexpensive to produce, so that the heat exchanger tube support of the present invention is less expensive to manufacture than known heat exchanger tube supports.

Significantly, the tube support according to the present invention utilizes the bundle of tubes being supported to provide increased rigidity and stability to the tube support. The tendency of one tube to move relative to the bundle is opposed by the simplified tube support through the symmetrical arrangement of the individual tubes about the tube support. Thus, the tube support becomes substantially more rigid with the tubes in place than it is prior to the insertion of the tubes.

In this way, the heat exchanger tube support provides a rigid structure for maintaining the heat exchanger tubes in a spaced, parallel relationship within the conduits. Movement of each tube within the support is resisted by the band which securely holds the tube in contact with the diverging arm and intermediate portion of each channel. Movement of the bundle of tubes is resisted by the leg sections which have end portions contacting the inner wall of the conduit at spaced intervals. Thus, each tube is securely held within the support while the bundle of tubes is itself secured within the conduit.

Although the heat exchanger tube support of the present invention has been described in connection with the preferred embodiment thereof, it will be appreciated by those skilled in the art that additions, modifications, substitutions and deletions not specifically described may be made without departing from the spirit and scope of the invention defined in the appended claims.

What is claimed is:

1. A heat exchanger tube support for supporting a plurality of heat exchanger tubes within a conduit of a heat exchanger, comprising:

three elements, each being a strip of material defining a radially extending projection at a mid-section thereof, two leg sections extending from the projection, and a channel being defined between each leg section and the projection; and means for securing the elements together with a leg section of each element being secured to a leg section of each adjacent element, with each leg section extending radially outward, and with the channels of each element opening radially outward, the three elements enclosing an interior area within the heat exchanger tube support.

2. The support of claim 1, wherein the three elements have identical configurations.

3. The support of claim 1, wherein each of the elements is symetrical about its projection.

4. The support of claim 1, wherein each element has a generally concave side and a generally convex side and wherein its projection extends into an area partially encompassed by the concave side.

5. The support of claim 1, wherein the projection of each element includes two arms diverging from an apex of the projection, each arm being connected to a leg section of the element.

6. The support of claim 1, wherein the means for securing the elements together includes spot welds located between end portions of the leg sections of adjacent elements.

7. The support of claim 1, wherein each channel is adapted to receive at least one heat exchanger tube and the projection and leg sections of each element are adapted to separate heat exchanger tubes in adjacent channels.

8. A heat exchanger tube support for supporting a plurality of heat exchanger tubes within a conduit of a heat exchanger, comprising:

three metal elements having identical configurations, each of said elements defining a generally concave side and a generally convex side and including a radially extending projection defined in a central area of the element, the projection including two arms diverging from an apex of the projection and extending into an area partially encompassed by the concave side, a leg section extending from each diverging arm, the leg section including an intermediate portion and an end portion, the intermediate portion extending from a diverging arm to the end portion, the end portion extending at an angle from the intermediate portion to an inside wall of the conduit, a channel defined between each diverging arm of the projection and each intermediate portion of each leg section, each channel being adaped to receive a heat exchanger tube with adjacent heat exchanger tubes being separated by at least one of the projections and leg sections;

means for securing an end portion of each element to an end portion of an adjacent element with each end portion extending radially outward, with each channel opening radially outward, and with the three elements enclosing an interior area within the heat exchanger tube support, the interior area being adapted to receive a heat exchanger tube; and means for securing the heat exchanger tubes within the channels.

9. A heat exchager having a heat exchanger tube support, comprising:

a conduit, a plurality of heat exchanger tubes arranged within the conduit;

a heat exchanger tube support which supports said plurality of tubes within the conduit, each of said tubes being spaced from one another and from an inside wall of the conduit, the heat exchanger tube support including three identical elements, each element being a strip of material defining a projection at a mid-section of the element, two leg sections extending from the projection and a channel being defined between each leg section and the projection, the three elements being connected together at the leg sections of adjacent elements, with each element being connected to an adjacent element, each channel receiving at least one heat exchanger tube and the projection and leg sections of each element separating the heat exchanger tubes in adjacent channels.

10. The heat exchanger of claim 9, further comprising means for securing the heat exchanger tubes within the channels.

11. The heat exchanger of claim 10, wherein the means for securing the heat exchanger tubes includes a band which surrounds the tubes.

12. The heat exchanger of claim 10, further comprising means for spacing the heat exchanger tubes from an inside wall of the conduit.

13. The heat exchanger of claim 12, wherein the leg sections of adjacent elements extend radially to the inside wall of the conduit, each leg section having a length sufficient to space the tubes from the inside wall of the conduit.

14. The heat exchanger of claim 9, wherein at least one heat exchanger tube is arranged centrally within the three elements.

* * * * *